United States Patent [19]

Rief

[11] 4,142,723

[45] Mar. 6, 1979

[54] TARGET WITH DIGITAL RECORDER

[76] Inventor: George A. Rief, P.O. Box 184, Dannebrog, Nebr. 68831

[21] Appl. No.: 804,067

[22] Filed: Jun. 6, 1977

[51] Int. Cl.[2] ..... F41J 5/04

[52] U.S. Cl. ..... 273/102.2 R

[58] Field of Search ..... 273/102.2 R, 102.2 S, 273/102.1 C

[56] References Cited

U.S. PATENT DOCUMENTS

| | | | |
|---|---|---|---|
| 232,417 | 9/1880 | Savage | 273/102.2 R |
| 346,876 | 8/1886 | Ullman | 273/102.2 R |
| 660,887 | 10/1900 | Chevallier et al. | 273/102.2 R |
| 1,041,258 | 10/1912 | Ellis | 273/102.2 R |
| 2,695,173 | 11/1954 | Sterne | 273/102.2 R |
| 2,784,001 | 3/1957 | Simjian | 273/102.2 R |
| 2,973,964 | 3/1961 | Zito | 273/102.2 S |
| 3,006,648 | 10/1961 | Devitt | 273/102.2 R |
| 3,193,818 | 7/1965 | McDannold | 273/102.2 R |
| 3,454,276 | 7/1969 | Brenkert et al. | 273/102.2 R |
| 3,678,495 | 7/1972 | Gilbert | 273/102.2 S |
| 3,690,661 | 9/1972 | Scharz et al. | 273/102.2 R |

*Primary Examiner*—Richard C. Pinkham
*Assistant Examiner*—Lawrence E. Anderson

[57] ABSTRACT

The purpose of this device is to respond to bullet strikes on a target as an aid in "sighting in" firearms, competition target shooting, or amusement.

2 Claims, 7 Drawing Figures

TARGET WITH DIGITAL RECORDER

It is a target of steel or suitable material of such design to conform to regulations governing size and shape of nationally recognized targets. It serves as a switching device to record, enumerate and designate where on the target the hit occurred.

BRIEF DESCRIPTION OF THE DRAWING

Sheet 1 of drawings shows a sample target (FIG. 1), less brackets or stands that it might need in different circumstances. It will be connected to recorders (FIG. 2, 3 or 4) at the firing line by a cable containing the necessary number of wires.

DETAILED DESCRIPTION OF THE INVENTION

Figure 1:
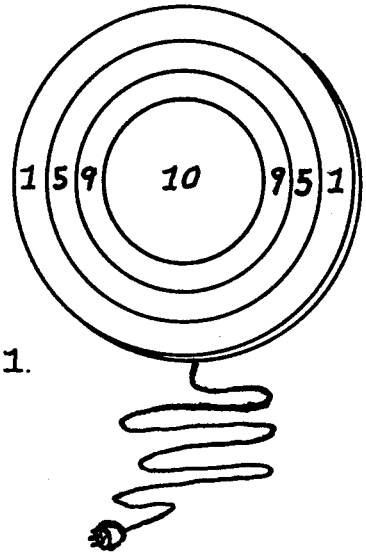

The target (FIG. 1) will have the number and width of rings to be suitable for the distance from the shooter or to meet whatever regulations required for competitive shooting. It will be constructed of steel or other material of sufficient thickness and strength to withstand bullet impacts.

Figure 2:
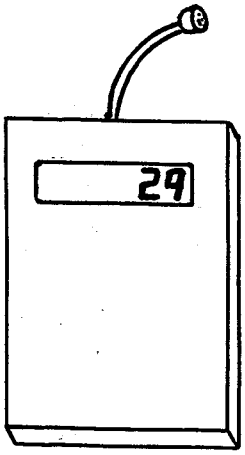
Figure 3:
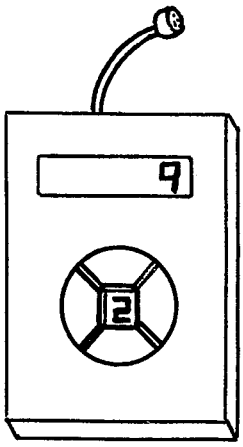
Figure 4:
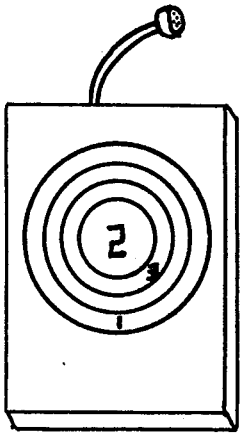

Recorders (FIG. 2, 3, and 4) will have light-emitting diodes, proper electronic circuitry and batteries to designate, record or add the hits, depending on which mode of operation is called for. Recorder 2 would be primarily for informal competition or amusement. As it is shown, 29 on its display would mean 2 bullseyes and a hit on the 9 ring if 3 shots were fired. The cable connecting the target to the recorder would contain 1 common wire plus a return wire for every ring, for a total of 5 wires in the case of the target illustrated.

Recorder 3 would be of a type needed for National Rifle Association or Olympic matches where bullseyes are counted as X's and other rings scored separately. As drawn, the number 2 in the X window would indicate 2 bullseyes and the 9 would indicate a hit in the 9 ring for 3 shots. The structure of the target and the number of wires in the cable would be the same as required for recorder No. 2.

Recorder 4 is of the type necessary for "sighting-in" firearms to designate where on a particular ring a hit was made. It would require the copper contact rings (part 7) to be segmented instead of continuous. The number of segments would be determined by the degree of accuracy wanted. Four segments per ring would be the best minimum and 12 segments (1 for each hour hand position of the clock) would be the best choice. The bullseye ring would not need to be segmented as a strike on any edge would be considered close enough. The wires in the cable would now be increased in number to a common plus a wire for every segment of every ring. The recorder circuitry would then be arranged so that FIG. 4 as drawn would indicate possibly the first shot striking at 6 o-clock in the 1 ring. The rifleman would then adjust his sights upward. The next shot could indicate 1 in the 4 o-clock position in the 9 ring.

Two more shots without sight correction could then indicate 3 in the 9 ring as drawn. Correction up and left could result in 2 bullseyes in 2 more shots. An off-on switch on the recorders would remove and cancel all readings for a new trial. A plug and socket would provide quick fastening and release.

Figure 5:
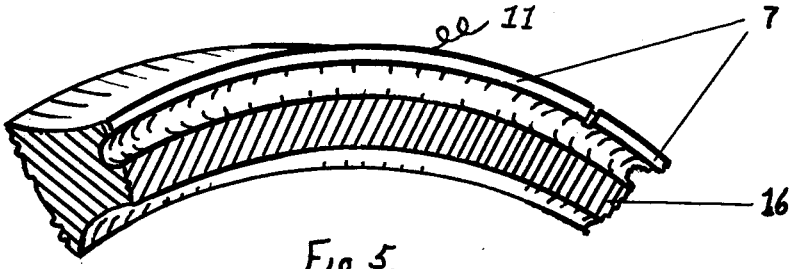
FIG. 5 shows a portion of the shock absorbing material mounted behind the scoring rings containing the contact points.

FIG. 5 shows a portion of the shock-absorbing material, possibly rubber, with the copper contact strips (7) embedded in it. FIG. 5 shows the contact strips being segmented as required for "sighting in" operations.

Figure 6:
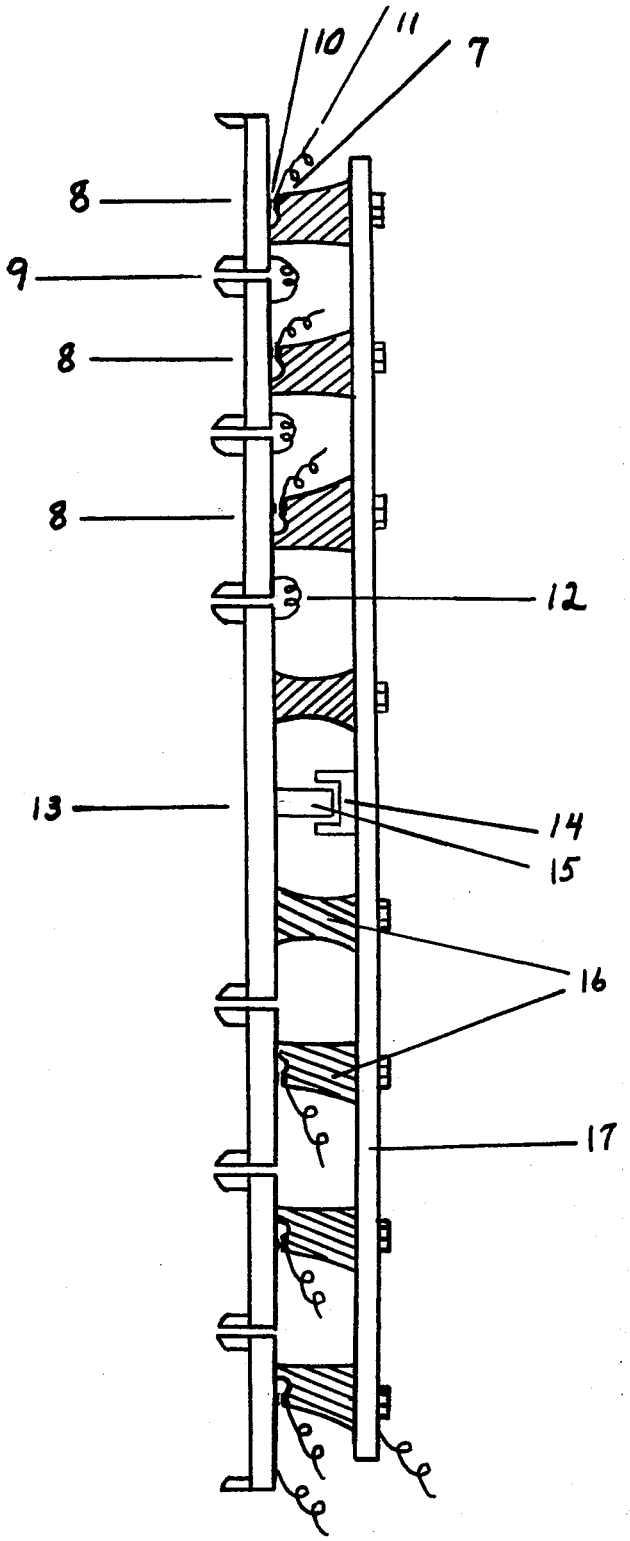
FIG. 6 is a cross section of the target showing the bullseye, rings, contacts, shock absorbing material and backing plate.

FIG. 6 is a side view of the target. Part 8 is one of the bullet proof target rings. Part 9 is one of the beveled projecting rings to reduce bullet splatter. The space between rings would be as small as possible to prevent lead from lodging between rings, yet not so close as to rub each other. Part 10 is the contacting surface on the target ring, which could be electroplated copper for best results.

Part 11 is one of the leads from the embedded copper contacts, whether continuos or segmented. Part 12 is a jumper wire between rings and bullseye. Part 13 is the bullseye ring. Its contact is the cup arrangement, part 14 and 15. A bullet strike dead center or on the edge of the bullseye results in the rod (part 15) striking the bottom or the side of the cup (part 14) making an electrical contact. The rubber or other resilient material (part 16) bonded to the target rings (parts 8 and 13) deflect enough from a bullet strike to close the contacts and energize the recorder. The whole assembly is screwed or bolted to the backing plate (17) to which may be attached brackets or other necessary means of holding the target upright.

I claim:

1. A target assembly comprising an impact receiver target and a corresponding target recorder, said impact receiver target comprising a circular central impact disc and a plurality of concentric conductive, impact rings adapted to be struck by a projectile; a backing plate; said impact rings being secured to said backing plate by annular, resilient, insulating members; said insulating members being nearly co-extensive with said impact rings; said insulating members having a first portion secured directly to the backing plate and impact ring and a second portion also secured to the backing plate but spaced from said impact ring; said second annular portion having an annular electrical contact strip imbedded therein which is connected to one of a first set of wires leading to the target recorder; the impact receiver target having a second set of wires leading to the target recorder which are connected to the impact rings; wherby when a projectile strikes the impact rings the annular, resilient, insulating members are compressed such that the annular contact strip contacts the impact ring thereby completing an electrical circuit to the target recorder and causing a digital indication to appear on the target recorder indicative of the particular impact ring which is struck.

2. A target assemblage as defined in claim 1 wherein the annular electrical contact strips of said second annular portion are segmented.

* * * * *